US005870012A

United States Patent [19]

Sakamaki et al.

[11] Patent Number: 5,870,012

[45] Date of Patent: Feb. 9, 1999

[54] ENGINE IGNITION COIL DEVICE

[75] Inventors: Makoto Sakamaki; Toshiyuki Shinozawa, both of Saitama, Japan

[73] Assignee: Toyo Denso Kabushiki Kaisha, Tokyo, Japan

[21] Appl. No.: 770,091

[22] Filed: Dec. 19, 1996

[30] Foreign Application Priority Data

Dec. 27, 1995 [JP] Japan ..... 7-354840
Dec. 27, 1995 [JP] Japan ..... 7-354841
Dec. 28, 1995 [JP] Japan ..... 7-354878

[51] Int. Cl.[6] ..... H01F 27/04; H01F 27/02; F02P 11/00

[52] U.S. Cl. ..... 336/107; 336/90; 336/92; 123/634; 123/621

[58] Field of Search ..... 336/107, 105, 336/96, 90, 92, 181, 182, 234; 123/634, 621, 635

[56] References Cited

FOREIGN PATENT DOCUMENTS 423296 5/1992 Japan ..... 123/150
587034 4/1993 Japan ..... 123/163

*Primary Examiner*—Michael L. Gellner
*Assistant Examiner*—Anh Mai
*Attorney, Agent, or Firm*—Lyon & Lyon LLP

[57] ABSTRACT

An engine ignition coil device which comprises a coil case composed of a first cylindrical case and a second case having a small tubular hole in its center portion and an upper external shoulder at its open end fitted in an open end of the first case to form a closed end of the coil case and an internal unit assembled from a primary side coil bobbin, a secondary-side coil bobbin having a high-voltage terminal holder projecting from a center of its end flange portion, a rod-shaped core, and a high-voltage terminal attached to the high-voltage terminal holder and having a contact for electrically connecting an ignition plug thereto. The internal assembly is mounted in the coil case by inserting the high-voltage terminal holder in the small tubular hole of the secondary case with a tip of the contact projected outwardly therefrom and formed integrally with the coil case by injecting melted insulating resin into the coil case. Thus, the inner assembly can be easily located and reliably fixed at a given place in the coil case with no additional member, assuring precise forming of an integral device by potting with resin.

8 Claims, 3 Drawing Sheets

ENGINE IGNITION COIL DEVICE

BACKGROUND OF THE INVENTION

The present invention relates to an engine ignition coil device.

Japanese Utility Model Publication No. 4-23296 discloses an open-magnetic-circuit-type engine ignition coil device that has a coil case which contains an assembly integrally molded therein by potting with melt insulating resin and consisting of a primary coil bobbin having a hollow interior with a rod-shaped core and a secondary coil bobbin coaxially laid on the primary coil bobbin, and which is further provided with an ignition-plug connector portion integrally formed on the coil case in such a way that tip of an ignition plug inserted therein can be in contact with a high-voltage terminal projecting inwardly into the connector portion of the coil case.

Japanese Laid-Open Patent No. 5-87034 also discloses an engine ignition coil device with an incorporated igniter, which comprises a single cylindrical coil case having an open top and a closed bottom, wherein a primary coil and secondary coil bobbin having a hollow shaft with a core inserted therein is mounted and integrally molded by potting with melt insulating resin and, then, an igniter with an attached thereto heat sink is mounted in an upper portion of the open top end of the coil case, leaving the heat sink exposed outside, and integrally molded therein by potting with melted resin.

The above-mentioned prior art devices, however, involve the following problems to be solved:

The first problem is that an inner assembly of a primary coil bobbin, a secondary coil bobbin, a rod type core and a high-voltage terminal socket may be displaced from a specified position in a coil case while melted resin is poured into the coil case. This results in a problem that the tip of an ignition plug can not properly fit in a high-voltage terminal socket integrally molded in the coil case.

The assembly consisting of the primary coil bobbin, secondary coil bobbin, rod type core and high-voltage terminal socket must be fixed in the required position by using suitable additional means that may require additional parts and additional processing steps. Consequently, the efficiency of manufacturing the ignition coil device is decreased.

The second problem is that the conventional open-magnetic-circuit type engine ignition coil device has a rod-shaped core inserted in a hollow shaft of a bobbin with a primary coil and a secondary coil and, therefore, has a low output-efficiency because the magnetic flux produced can extend outwards and is reduced by iron loss while passing the cylinder head and block of the engine. Consequently, the conventional device necessarily has an increased size to assure a specified secondary output voltage.

Further, the solidified resin layer between the coil case and the inner assembly may suffer thermal-stress cracking that allows current leakage resulting in impairing the resin quality.

The third problem of the conventional device is that an igniter with a heat sink is potted only at its bottom and sides in resin layer in the open top end of a coil case and may come out of the coil case.

In the conventional device, the igniter is mounted in the case independent of a low-voltage terminal socket integrally formed with the coil case. This requires a separate step of wiring between the igniter and the low-voltage terminal, thereby reducing the assembling work efficiency.

The fourth problem is that a conventional engine ignition coil device with an ignition plug directly attached thereto is formed in a single piece and therefore must be prepared in different sizes depending upon the kinds of engines that have different sizes between a mounting seat of an ignition coil device and an ignition plug.

SUMMARY OF THE INVENTION

In view of the foregoing, it is an object of the present invention to provide an engine ignition coil device which comprises a coil case composed of a first cylindrical case and a second cylindrical case having a small tubular hole in its center portion and an upper external shoulder at its open end fitted into an open end of the first case to form a closed end of the coil case and an inner assembly consisting of a primary coil bobbin, a secondary coil bobbin having a high-voltage terminal holder projecting in a center of its end flange portion, a rod-shaped core and a high-voltage terminal attached to the high-voltage terminal holder and having a contact for electrically connecting an ignition plug thereto and which coil case with the internal assembly mounted therein with the high-voltage terminal holder press-fitted in the small tubular hole of the secondary case to project a tip of the contact outside therefrom is potted with melted insulating resin injected through an open-end of the coil case to form a single solid device, thus the inner assembly can be easily fixed at a given place in the coil case with no additional member, assuring precise electrical connections with an ignition plug directly attached to the device.

Another object of the present invention is to provide an open-magnetic-circuit type engine ignition coil device which comprises a coil case, an assembly of a hollow primary coil bobbin and a secondary coil bobbin with a rod-shape core inserted in the hollow primary coil bobbin and which is featured in that the case body for accommodating therein the inner assembly is a cylinder made of metal having a high magnetic permeability, which cylinder has a longitudinal gap-forming slit and is covered internally with an elastic member, and a resin layer is formed between the covering elastic member and the assembly, thus improving an output efficiency and preventing thermal-stress cracking from being formed in the solidified resin-layer.

Another object of the present invention is to provide an engine ignition coil device including an igniter, which is reliable and easy to assemble, wherein a low-voltage terminal-socket holder is inserted into an open end of a coil case for communication with the internal assembly mounted therein and an igniter is mounted with a heat sink thereabove in the socket holder, then the holder is potted with melted resin to the level at which the igniter and the heat sink are immersed and is covered with a cap whose internal ribs are also immersed in the melted resin to form a single solid body.

Another object of the present invention is to provide an engine ignition coil device including an igniter, which has a three-piece coil-case composed of a first cylindrical case for accommodating therein an ignition coil assembly, a second case fitted in the open bottom end of the first case and a low-voltage terminal socket portion fitted in the open top end of the first case, thus allowing exchanging the second case or the socket portion for another one of different size in accordance with another engine having a different mounting size for the ignition coil.

DESCRIPTION OF THE PREFERRED EMBODIMENT

The preferred embodiment of the present invention will now be described in detail by way of example and with reference to the accompanying drawings.

Figure 1:
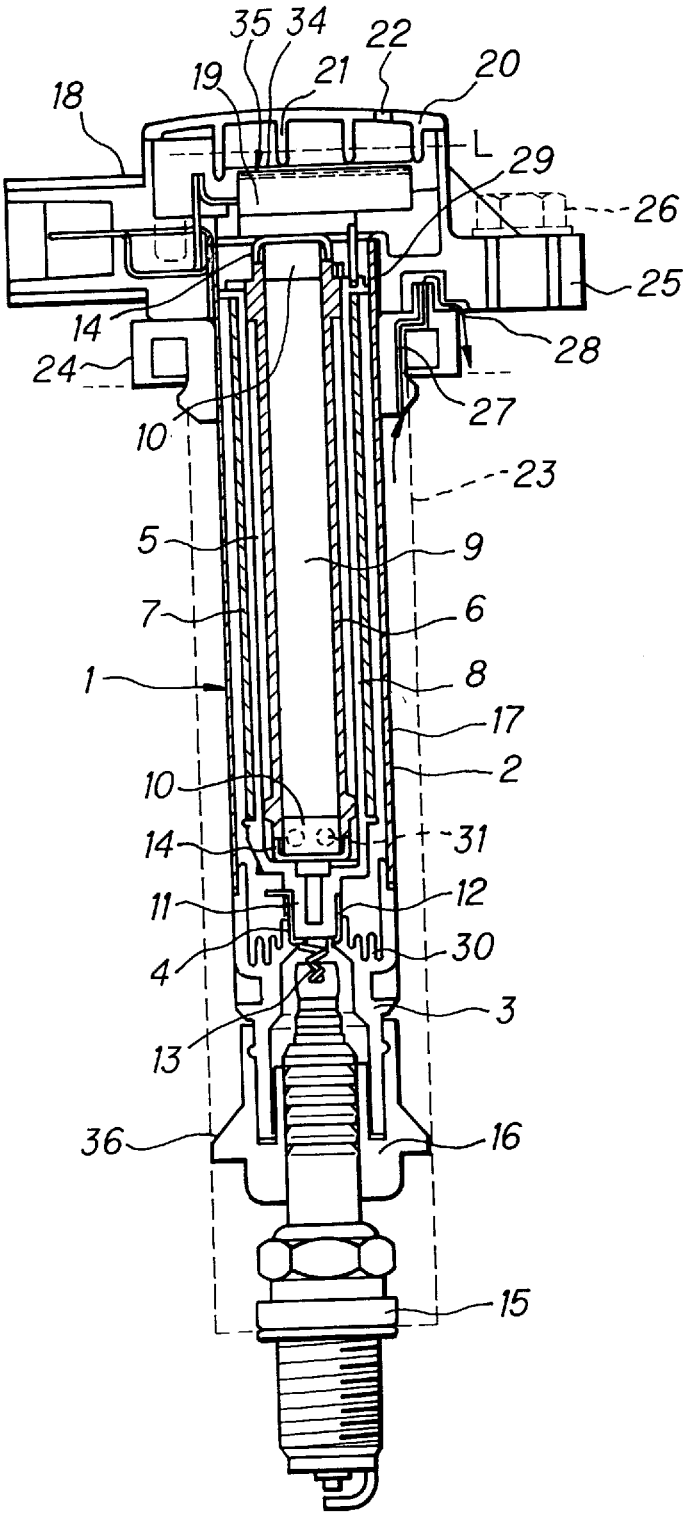
FIG. 1 is a sectional front view of an engine ignition coil device embodying the present invention.

As shown in FIG. 1, an engine ignition coil device according to the present invention has a coil case 1 composed of a cylindrical case 2 and a case 3 having a small tubular hole 4 in its center portion and an upper external shoulder fitted in an open end of the case 2 to form a closed end of the coil case 1.

The coil case 1 accommodates an assembly of a hollow tubular coil bobbin 6 with a primary coil 5 on the exterior and a rod-shaped core 9 inserted therein, and a hollow tubular coil bobbin 8 with a secondary coil 7 coaxially mounted on the coil bobbin 6. The core 9 is provided at each end with a permanent magnet 10 for obtaining a large change in magnetic flux with an interrupted primary current.

Figure 2:
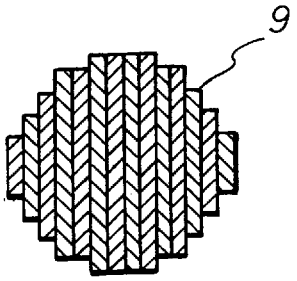
FIG. 2 is a sectional top view of a core of the engine ignition coil device shown in FIG. 1.

As shown in FIG. 2, the core 9 is composed of laminations of iron plates having different widths with a stepped nearly circular section so that a magnetic flux may be effectively produced by increasing its space factor in the hollow interior of the cylindrical coil bobbin 6.

A high-voltage terminal holder 11 is a center projection formed integrally with the flanged end portion of the secondary coil bobbin 8. A high-voltage terminal 12 bonded to the holder 11 has a contact 13 attached thereto for providing electrical connection with an ignition plug 15.

The assembly of the primary coil bobbin 6, secondary coil bobbin 8, high-voltage terminal 12 and contact 13 is mounted at a given place and fixed in the coil case 1 in such a manner that a holder portion of the high-voltage terminal 12 is press-fitted in the small hole 4 of the coil case 1 and the contact 13 projects outwardly from the small hole 4.

The coil case 1 with the assembly fixed at the given place therein is filled with melted insulating resin injected through the open-end of the top of the coil case 1 to form a single solid device.

The permanent magnets 10 that are attached to each end of the core 9 are covered with damping members 14, respectively, which can prevent intrusion of melted resin into the core 9 and absorb relatively large thermal stress produced in the longitudinal direction of the core 9, thus preventing cracking of the resin layer formed around the core 9.

A space formed between the primary coil bobbin 6 and the secondary coil bobbin 8 is filled with melted resin entered therein through a plurality of holes 31 made in the high-voltage terminal holder 11 at the flanged end portion of the secondary coil bobbin 8. The two bobbins are fixed to each other with the resin layer formed therebetween.

The case 3 also functions as a connector for the ignition plug 15 and is provided at its bottom end with a plug rubber 16 for holding the ignition plug 15. When the ignition plug 15 is inserted into the plug rubber 16, a tip of the ignition plug 15 comes into contact with the contact 13, making electrical connection with the ignition coil device.

The case 2 is made of dielectromagnetic material having a high permeability, e.g., silicone steel, which has an electromagnetic shielding effect and acts as a side core for concentrating a large portion of the magnetic flux produced by the open-magnetic-circuit type core 9 into the case 2, thus preventing loss of the produced magnetic flux by passing into a cylinder head and/or block of the engine that would cause a drop of a secondary output voltage. The case 2 itself has a thermal radiation effect.

An optimal length of the case 2 lies within the range of 1 to 1.3-times the length of the core 9. The magnetic flux produced by the core 9 may expand with an increased magnetic resistance if the case 2 is shorter than the above-mentioned value. A longer case 2 has no effect.

The case 3 has a plurality of ribs 30 formed between the small hole 4 and the side wall to assure an insulation distance between the high-voltage terminal 12 fitted in the small hole 4 and the case 2.

Figure 3:
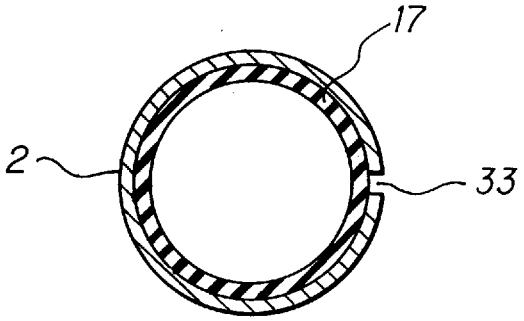
FIG. 3 is a sectional top view of a first case of the engine ignition coil device shown in FIG. 1.

As shown in FIG. 3, the case 2 has a split 33 to form a gap of 0.5 to 1.5 mm in the longitudinal direction and a C-shaped section to minimize an eddy current core loss.

The case 2 is internally covered with an elastic member 17 (e.g., rubber, elastomer) which separates the resin layer from the inner wall of the case 2 and adsorbs thermal stress of the metal, thus preventing the resin layer from cracking. This interposed member 17 can effectively prevent deterioration of the resin layer due to leakage current and can therefore improve safety and durability of the device.

As shown in FIG. 1, a low-voltage terminal socket holder 18 is fitted on an open top-end of the case 2. An igniter 19, which is a conventional transistor switching device for an electronic ignition system, and an element 35 including a heat sink 34 are mounted in the holder 18 with the heat sink 34 positioned uppermost in the holder 18. Melted resin is poured from the top into the holder 18 until the element 35 is immersed in liquid resin (level L in FIG. 1), then a cap 20 with ribs 21 is laid on the holder 18 in such a way that the ribs 21 are inserted into the liquid resin layer above the heat sink 34. The cap 20 and the holder 18 are thus integrally formed with the top-end of the case 2.

The element 35 with the heat sink 34 is integrally formed with the igniter 19 as a preassembled unit by laying the heat sink 34 on the igniter and covering them with an even, thick (1–5 mm) layer of resin that has thermoplasticity for relating thermal stress and has an affinity with the potting resin. The resin layer of the limonite 35 relaxes thermal stress from the core 9 to prevent damage to the igniter 19. The resin layer on the element 19 can not be stripped off and is effective to protect the surrounding resin layer against thermal stress cracking.

The heat sink 34 in the element 35 can effectively release heat of the igniter 19 because it is arranged on the opposite side with respect to the heat-generating core 9.

The cap 20 has a plurality of the ribs 21 that serve as a cushion for dispersion thermal stress to the resin layer, thus preventing cracking of the resin layer on the igniter 19.

Heat from the heat-sink 34 is effectively disposed through the ribs 21 potted in the resin layer above the heat sink 34.

The cap 20 has an air vent hole 22 through which internal pressure can be released without forcing the cap 20 upwardly from the device and inside heat is also effectively released.

Figure 4:
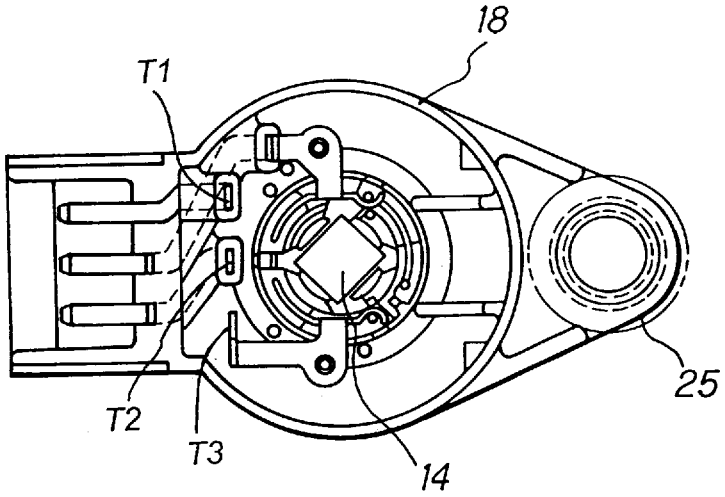
FIG. 4 is a plan view showing an internal structure of a holder of a low-voltage terminal socket portion of the engine ignition coil device shown in FIG. 1.
Figure 5:
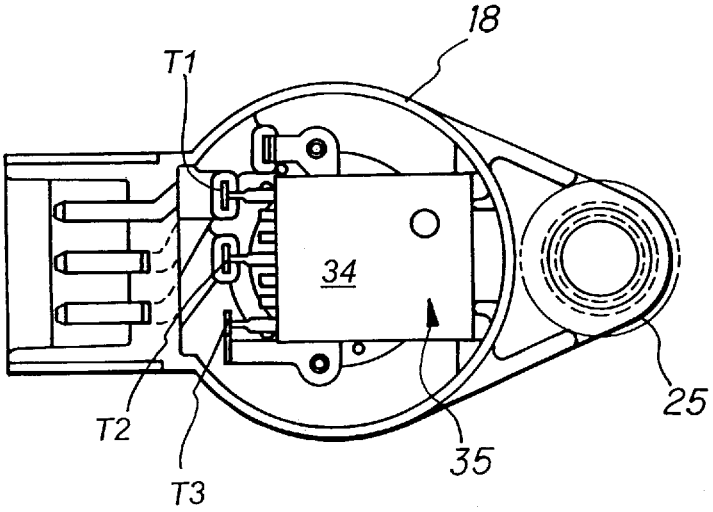
FIG. 5 is a plan view of an engine ignition coil device in a state that an element consisting of an igniter and a heat sink is mounted on a low-voltage terminal socket holder.

FIG. 4 shows an internal structure of the low-voltage-terminal socket holder 18 with the cap 20 removed. FIG. 5 shows the low-voltage-terminal socket holder 18 with element 35 mounted therein.

The holder 18 contains connecting terminals T1–T3 of the igniter 19, which can engage with terminals of the igniter 19 when the element 35 is mounted at a given place in the holder 18.

This eliminates the necessity to provide wires for the low-voltage terminals of the igniter 19, thus making it easy to assemble the device.

The low-voltage-terminal socket 18 is fitted on an outwardly folded portion 29 of the elastic member 17 that is provided on the inside wall of the case 2 to assure a high sealing quality.

As shown in FIG. 1, the case 2, below the low-voltage-terminal socket holder 18, is provided with a rubber seal 24 that is used when the coil case 1 is mounted in a cylindrical bore 23 provided in a cylinder head portion of an engine.

With the coil case 1 mounted in the cylinder bore 23, this ignition coil device is secured at its flange 25 to the cylinder head with a bolt 26 through a hole in the flange 25 that is integrally formed with the holder 18.

To prevent air pressure from increasing by heat in the embedded portion of the coil case 1 in the cylindrical bore 23, air vent holes 27 and 28 communicating with each other are provided through the rubber seal 24 and the low-voltage-terminal socket 18. The flow of air is indicated by the arrows in FIG. 1.

The plug rubber 16 has a flange 36 formed at its circumference. This flange 36 has the same diameter as the diameter of the cylindrical bore 23 and serves as a guide for inserting the coil case 1 into the cylinder bore 23 to assure the reliable connection with the ignition plug 15. The engine vibration transmitted through the ignition plug 15 to the coil case 1 is absorbed by the flange 23. The vibration applied to electrical connections between the contact 13 and the ignition plug 15 also is suppressed, thus the durability of the device is improved.

As described above, the present invention provides an engine ignition coil device that has the following improvements:

In a preferred embodiment of an engine ignition coil device according to an aspect of the present invention, which comprises a coil case composed of a first cylindrical case and a second cylindrical case having a small tubular hole in its center portion and an upper external shoulder fitted in an open end of the first case to form a closed end of the coil case and an internal assembly composed of a primary side coil bobbin, a secondary-side coil bobbin having a high-voltage terminal holder projecting from a center of its end flange portion a rod-shaped core and a high-voltage terminal attached to the high-voltage terminal holder and having a contact for electrically connecting an ignition plug thereto, the assembly is mounted in the coil case by inserting the high-voltage terminal holder in the small tubular hole of the secondary case in such a way that a tip of the contact is projecting outwards from the hole, then melted insulating resin is injected through an open-end of the coil case to form a single solid device with solidified resin therein. Thus, the inner assembly can be easily located and reliably fixed at a given place in the coil case with no additional member, assuring precise forming of an integral device by potting with resin and reliable electrical connections with an igniting plug directly attached to the device. The device is easy to manufacture with an increased quality.

In the ignition coil device according to another aspect of the present invention, the first case for accommodating therein the inner assembly is a cylinder made of metal having a high magnetic permeability, which has a gap-forming slit in the longitudinal direction thereof. Thus, most of the magnetic flux produced by the core can pass into the first case portion without expanding around and, therefore, an improved output efficiency is assured.

In the ignition coil device according to another aspect of the present invention the first case is covered internally with an elastic member and an insulating resin layer is formed between the covering member and the assembly. This elastic covering can effectively absorb thermal stress, thereby preventing thermal-stress cracking of the solidified resin-layer. The resin layer can therefore serve as a high quality insulation with no leakage current from the core, assuring reliable and safe operation of the device.

In the ignition coil device according to another aspect of the present invention, the low-voltage terminal-socket holder is inserted into an open end of a coil case for communication with the internal assembly mounted therein and an igniter is mounted in the socket holder, thus the igniter is easily mounted without additional wiring and the assembly work is improved.

The socket holder wherein the igniter is mounted with a heat sink thereabove is filled with melted resin until the igniter and the heat sink are completely immersed in the liquid resin and, then, covered with a cap with its ribs immersed in the liquid resin to form a solid unit, thus assuring reliable structure of the igniter with an excellent cooling efficiency.

In an ignition coil device including an ignition plug directly mounted therein according to another aspect of the present invention, a coil case is of the three-piece type that is composed of:

a first cylindrical case for accommodating therein an ignition coil assembly; a second case fitted in the open bottom-end of the first case and attached to a plug for electrically connecting thereto a secondary high-voltage terminal; and a low-voltage terminal socket fitted in the open top-end of the first case. This allows the ignition coil device to be adaptable to any of engines having different mounting sizes from the ignition coil mounting seat to the ignition plug by exchanging the second case and the low-voltage terminal for suitable units.

The ignition coil device can be available with size-and-shape variations of low-voltage terminals adaptable to variations of mounting seats in engine cylinder head portions.

What is claimed:

1. An open-magnetic-circuit type engine ignition coil device comprising:

a coil case composed of only a first cylindrical case and a second cylindrical case having a small unthreaded tubular hole in its center portion and an upper external shoulder at its open end fitted into an open end of the first case to form a closed end of the coil case; and an internal assembly consisting of a primary coil bobbin, a secondary coil bobbin with a projecting high-voltage terminal holder formed at a center of an end flange portion of the secondary coil bobbin, a rod-shaped core, and a high-voltage terminal attached to the high-voltage terminal holder and having a contact for electrically connecting an ignition plug thereto, characterized in that the coil case and the internal assembly mounted therein with the high-voltage terminal holder press-fitted in the small unthreaded tubular hole of the second cylindrical case with a tip of the contact projected outwardly therefrom are integrally formed with each other by filling the coil case with melted insulating resin through an openend of the coil case, and characterized in that said first cylindrical case is an electromagnetic shielding case.

2. An engine ignition coil device as defined in claim 1, characterized in that the second case also serves as a connector for the ignition plug.

3. An engine ignition coil device as defined in claim 1, characterized in that the first case is a cylinder made of metal having a high magnetic permeability, which cylinder has a longitudinal gap-forming slit and is covered internally with an elastic member.

4. An engine ignition coil device as defined in claim 1, characterized in that a low-voltage terminal-socket holder is inserted into an open end of the first case for communication with the assembly mounted therein and an igniter is mounted with a heat sink in an upper position in the socket holder, then the holder is potted with insulating resin to the level at which the igniter and the heat sink are immersed in the resin and is covered with a cap with ribs immersed in the resin to form a single solid unit.

5. An engine ignition coil device as defined in claim 4, characterized in that the igniter and the heat sink are formed integrally with each other by covering them with an evenly thick layer of insulating thermoplastic material.

6. An engine ignition coil device as defined in claim 4, characterized in that the ignition coil device has a three-piece external body composed entirely of the first case, the second case and the low-voltage-terminal socket holder.

7. An open-magnetic-circuit type engine ignition coil device comprising:

a coil case composed of a first cylindrical case and a second cylindrical case having a small tubular hole in its center portion and an upper external shoulder at its open end fitted into an open end of the first case to form a closed end of the coil case; and an internal assembly consisting of a primary coil bobbin, a secondary coil bobbin with a projecting high-voltage terminal holder formed at a center of an end flange portion of the secondary coil bobbin, a rod-shaped core, and a high-voltage terminal attached to the high-voltage terminal holder and having a contact for electrically connecting an ignition plug thereto, characterized in that the coil case and the internal assembly mounted therein with the high-voltage terminal holder press-fitted in the small tubular hole of the secondary case with a tip of the contact projected outwardly therefrom are integrally formed with each other by filling the coil case with melted insulating resin through an open end of the coil case; and a low-voltage terminal socket holder inserted into an open end of said first cylindrical case at said open end of the coil case for communication with said internal assembly mounted therein, and an igniter mounted with a heat sink in an upper position in the socket holder, characterized in that then the holder is potted with insulating resin to the level at which the igniter and the heat sink are immersed in the resin and the holder is covered with a cap with ribs immersed in the resin to form a single solid unit; and further characterized in that the cap has a plurality of inwardly formed ribs for dispersing thermal stress to be applied to a molded resin layer.

8. An open-magnetic-circuit type engine ignition coil device comprising:

a coil case composed of a first cylindrical case and a second cylindrical case having a small tubular hole in its center portion and an upper external shoulder at its open end fitted into an open end of the first case to form a closed end of the coil case; and an internal assembly consisting of a primary coil bobbin, a secondary coil bobbin with a projecting high-voltage terminal holder formed at a center of an end flange portion of the secondary coil bobbin a rod-shaped core, and a high-voltage terminal attached to the high-voltage terminal holder and having a contact for electrically connecting an ignition plug thereto, characterized in that the coil case and the internal assembly mounted therein with the high-voltage terminal holder press-fitted in the small tubular hole of the secondary case with a tip of the contact projected outwardly therefrom are integrally formed with each other by filling the coil case with melted insulating resin through an open end of the coil case; and a low-voltage terminal socket holder inserted into an open end of said first cylindrical case at said open end of the coil case for communication with said internal assembly mounted therein, and an igniter mounted with a heat sink in an upper position in the socket holder, characterized in that then the holder is potted with insulating resin to the level at which the igniter and the heat sink are immersed in the resin and the holder is covered with a cap with ribs immersed in the resin to form a single solid unit; and further characterized in that the holder cap has an air vent hole made therein.

* * * * *

UNITED STATES PATENT AND TRADEMARK OFFICE

CERTIFICATE OF CORRECTION

PATENT NO. : 5,870,012

DATED : February 9, 1999

INVENTOR(S) : M. Sakamaki et al.

It is certified that error appears in the above-identified patent and that said Letters Patent is hereby corrected as shown below:

Column 7, claim 1, line 5, delete "openend" and substitute -- open-end --.

Signed and Sealed this

Thirtieth Day of November, 1999

*Attest:*

*Attesting Officer*

Q. TODD DICKINSON

*Acting Commissioner of Patents and Trademarks*